US005392757A

United States Patent [19]

Head et al.

[11] Patent Number: 5,392,757

[45] Date of Patent: Feb. 28, 1995

[54] CABLE GUARD

[75] Inventors: Paul A. Head; James R. Allshouse, both of Newburgh; Martin L. Forbes, Evansville, all of Ind.

[73] Assignee: Indian Industries, Inc., Evansville, Ind.

[21] Appl. No.: 158,895

[22] Filed: Nov. 29, 1993

[51] Int. Cl.[6] ..... F41B 5/14; F41B 5/10

[52] U.S. Cl. ..... 124/86; 124/25.6

[58] Field of Search ..... 124/23.1, 24.1, 25.6, 124/86, 88

[56] References Cited

U.S. PATENT DOCUMENTS

| | | | |
|---|---|---|---|
| 4,377,152 | 3/1983 | Saunders et al. | 124/88 |
| 4,452,222 | 6/1984 | Quartino et al. | 124/88 X |
| 4,685,439 | 8/1987 | Cosentino | 124/25.6 X |
| 4,741,320 | 5/1988 | Wiard | 124/25.6 X |
| 4,829,974 | 5/1989 | Anderson | 124/88 X |
| 4,886,038 | 12/1989 | Betters | 124/88 X |
| 4,903,678 | 2/1990 | Walker | 124/90 |
| 4,917,070 | 4/1990 | Townsend | 124/25.6 X |
| 4,919,108 | 4/1990 | Larson | 124/88 |
| 5,099,819 | 3/1992 | Simonds et al. | 124/23.1 |
| 5,146,908 | 9/1992 | Larson | 124/88 |
| 5,161,514 | 11/1992 | Cary | 124/24.1 |
| 5,178,122 | 1/1993 | Simonds | 124/25.6 |

*Primary Examiner*—Randolph A. Reese
*Assistant Examiner*—John A. Ricci
*Attorney, Agent, or Firm*—Woodard, Emhardt, Naughton, Moriarty & McNett

[57] ABSTRACT

An improved cable guard for a compound archery bow having a riser, upper and lower limbs extending from the riser, pulleys mounted on the limbs, one or more cables trained around the pulleys and spanning the limbs, and a bowstring extending between the limbs. The cable guard has a one-piece construction including integrally joined mounting and cable guard portions. The cable guard portion extends rearwardly from the riser offset from the plane of the bow. To minimize lateral deflection caused by side loads generated by the deflected cables, the cable guard portion has a beam height which is increased at the mounting portion joint and continually decreases towards the free end of the cable guard.

8 Claims, 4 Drawing Sheets

CABLE GUARD

BACKGROUND OF THE INVENTION

1. Field of the Invention

The subject invention relates generally to the field of archery bows and, more particularly, to cable guards for compound archery bows.

2. Description of the Prior Art

Compound archery bows use pulleys located at the extreme ends of the bow limbs to provide enhanced draw characteristics. However, unless somehow offset, the cables typically trained around the pulleys will normally extend undesirably close to the plane of the bow in a position which can interfere with the path of an arrow launched from the bow. It is a customary practice to provide such bows with a cable guard which extends rearwardly from a midpoint on the handle or riser portion of the bow and is sufficiently offset from the plane of the bow so that the cables are spaced laterally away from the arrow in a non-interfering position. In addition, a cable guide is slidably mounted on the guard and defines a pair of grooves in which the cables slide as the bow limbs are stressed. One current design of such cable guards employs a one-piece bent rod having shapes similar to those disclosed for example in U.S. Pat. No. 4,452,222 to Quartino et al. and U.S. Pat. No. 4,903,678 to Walker. This design can create problems when used with bows having a relatively short brace height because during operation the cable guide can slide into the bent portion, causing the cable guide to disorient itself relative to the cables and become dislodged therefrom. Also, because the deflection forces exerted by the cables against the cable guard increase as the bow is drawn and as the point of contact between the cables and cable guard moves rearwardly further away from the riser, the rearmost leg of the cable guard may be formed so that it is angled a few degrees relative to the plane of the bow. This helps the cable guard to overcome the side forces exerted by the cables and minimize the cable guard "leaning in" effect which otherwise can occur at full draw. The "leaning in" effect causes a problem in that the guard may not be able to return to a non-interfering position before the bowstring returns. This problem increases over time as increased usage causes the cable guard to experience material fatigue. While helpful to overcome the "leaning in" effect, such a modification is otherwise not desirable.

As an alternative to the bent type cable guard, two piece L-shaped cable guards have also been employed. An example of an L-shaped type cable guard is disclosed in U.S. Pat. No. 5,178,122 to Simonds. Such guards employ a straight rod which is mounted to the bow riser by a mounting member which extends normally to the rod a distance sufficient to provide a desired range of offset between the rod and the plane of the bow. This design eliminates the problems associated with the bent portion of the bent type cable guards, but contributes disadvantages of its own. For example, the two piece L-shaped type cable guards are structurally weaker and cause an even greater "leaning in" effect than do the bent type cable guards.

SUMMARY OF THE INVENTION

In one preferred embodiment, the present invention is characterized by a cable guard for a compound archery bow having a riser, upper and lower limbs extending from the riser, pulleys mounted on the limbs, one or more cables trained around the pulleys and spanning the limbs, and a bowstring extending between the limbs. The cable guard includes a one-piece cable guard member having integrally joined mounting and cable guard portions. The mounting portion is adapted to mount to the riser of the bow with the cable guard portion extending rearwardly from the riser offset from the plane of the bow. The cable guard portion has a generally cylindrically shaped cable guide slide surface facing the cables and a beam height which continually decreases from the mounting portion towards the free end of the cable guard.

It is an object of the present invention to provide an improved cable guard for a compound archery bow.

Related objects and advantages of the present invention will become even more apparent by reference to the following drawing figures and detailed description.

DESCRIPTION OF THE PREFERRED EMBODIMENT

Figure 1:
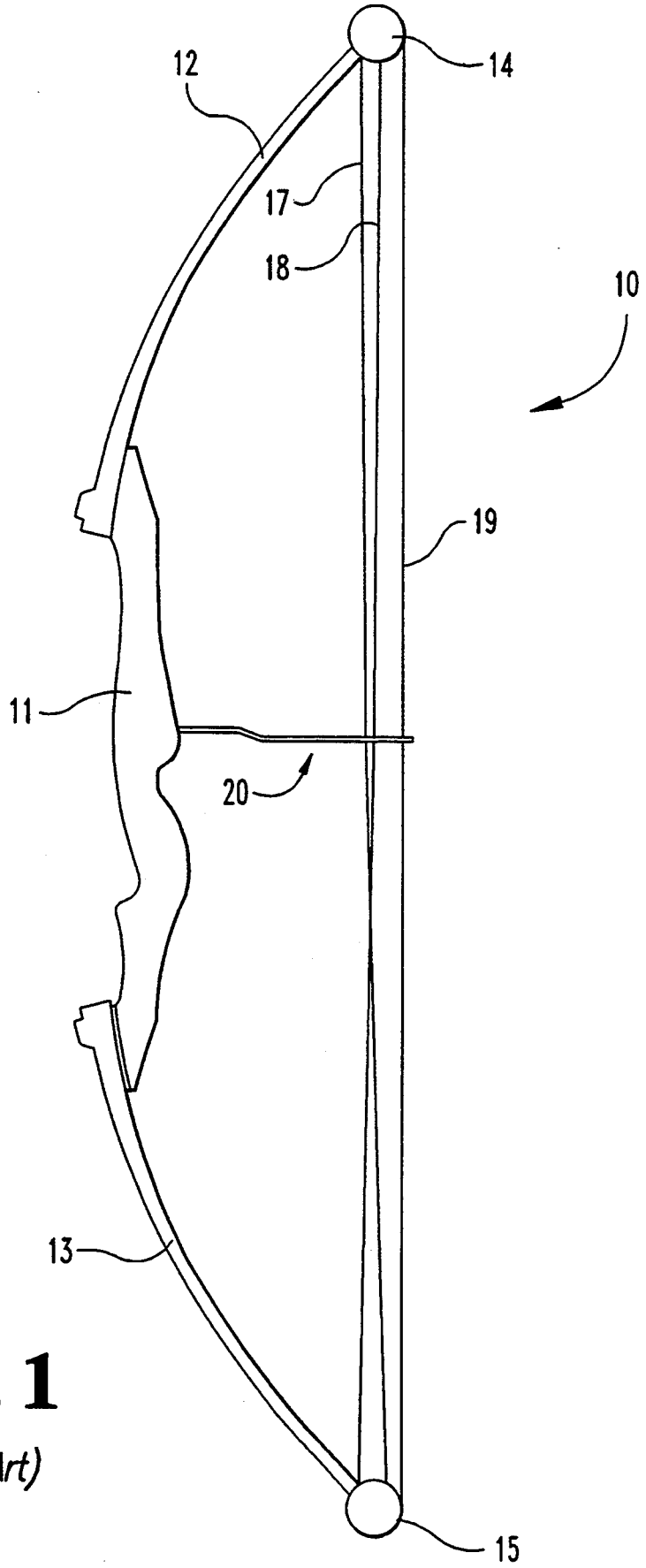
Fig. 1 (Prior Art)
FIG. 1 is an elevation view showing a compound archery bow with a bent rod type cable guard mounted theron.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows generally designated at 10 a compound archery bow of conventional design having, a bow handle riser 11, upper and lower limbs 12 and 13, respectively, extending from opposed ends of riser 11. Pulleys 14 and 15 are mounted to the tips of limbs 12 and 13, respectively. Cables 17 and 18 mount at opposite ends of bow 10, crossing one another as they span between limbs 12 and 13, and training around the pulley associated with the opposed limb. The free ends of cables 17 and 18 are attached to opposed ends of bowstring 19. A conventional cable guard 20, described herein as a bent rod type cable guard, is mounted to the bow handle riser via a standard threaded mounting hole in the rear of the riser and extends rearwardly therefrom. In conventional fashion, cable guard 20 serves to laterally deflect the cables 17 and 18 away from the plane of the bow defined by limbs 12 and 13 and bowstring 19.

FIGS. 2–5 show the improved cable guard 21 of the present invention. Cable guard 21 is designed so that it may be used with any conventional compound bow, such as for example is illustrated in FIG. 1, which has cables running in the plane of the bow and therefore requires cable deflection to a non-interfering position.

Figure 2:
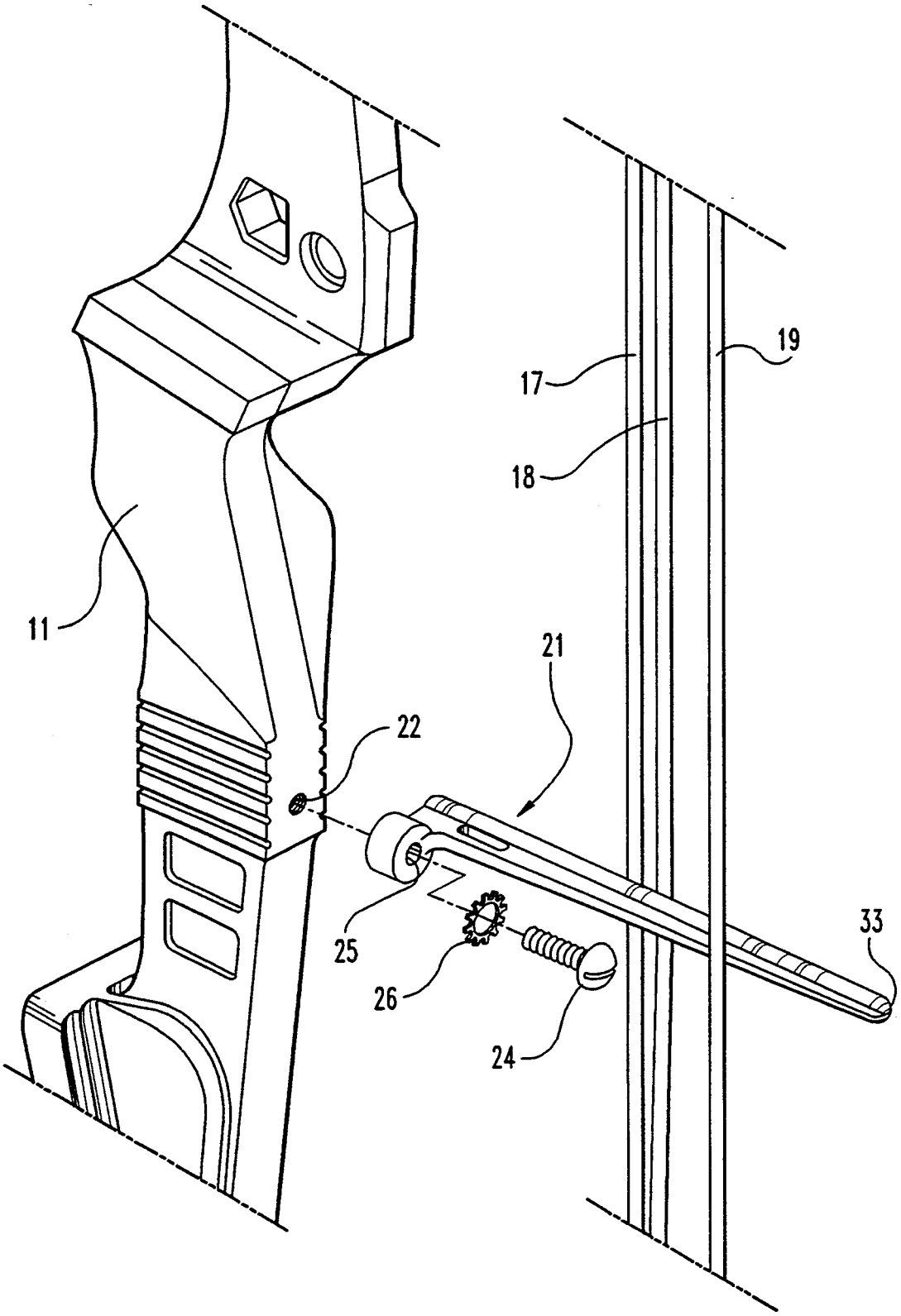
FIG. 2 is a fragmentary exploded perspective view showing a compound archery bow and cable guard of the present invention.
Figure 3:
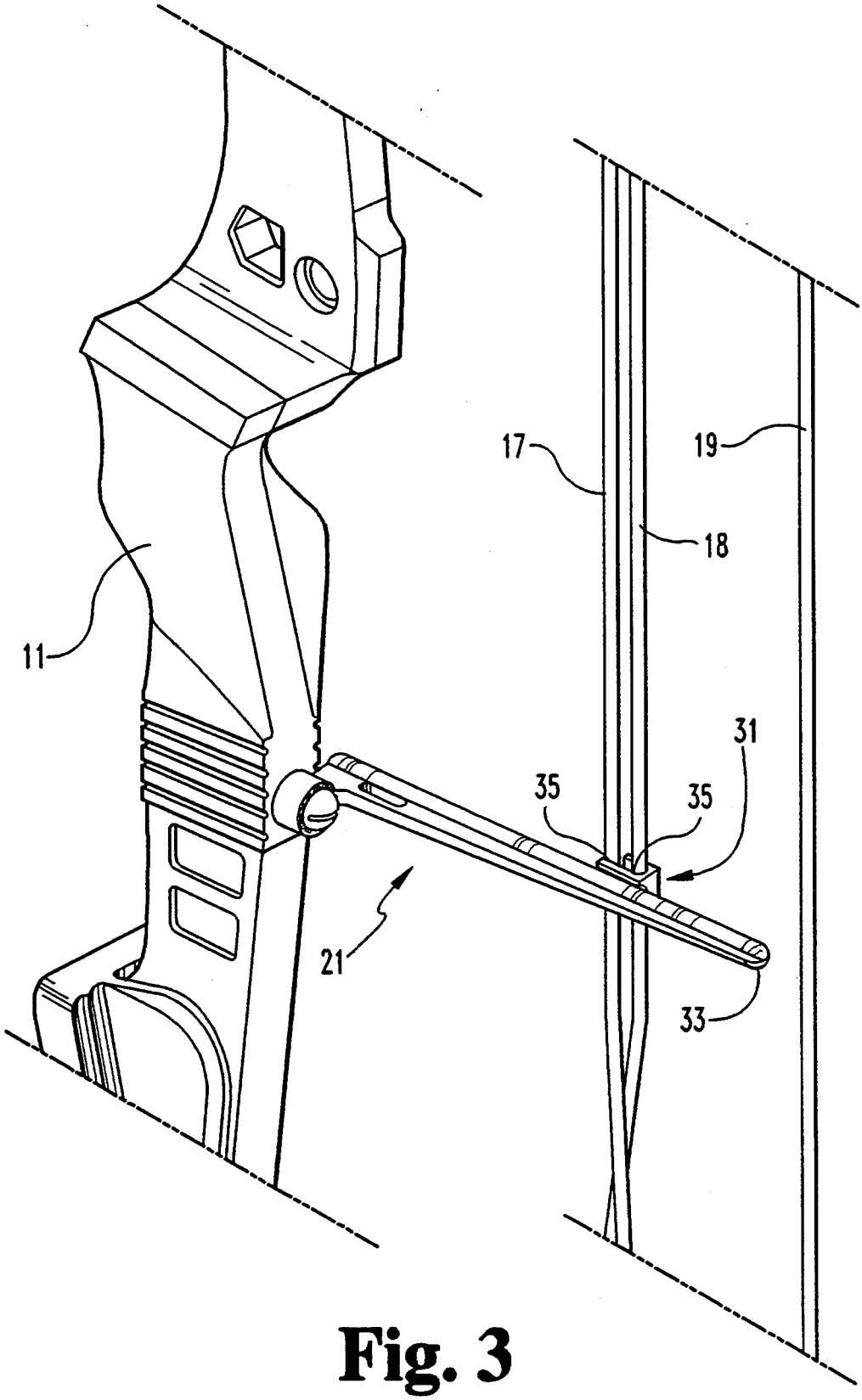
FIG. 3 is a fragmentary perspective view of the compound archery bow and cable guard of FIG. 2 assembled.

As seen in FIGS. 2 and 3, cable guard 21 mounts to bow 10 at the standard threaded mounting hole 22 located at the rear of riser 11. Relative rotation of cable guard 21 about mounting hole 22 allows for adjustment of the amount of cable deflection which is desired. Cable guard 21 is attached to hole 22 in riser 11 via a button head screw 24 received through mounting hole 25 and threadably advanced into hole 22. A star washer 26 secures the screw 24 in place. Alternatively, other types of mounting means may also be provided.

Figure 4:
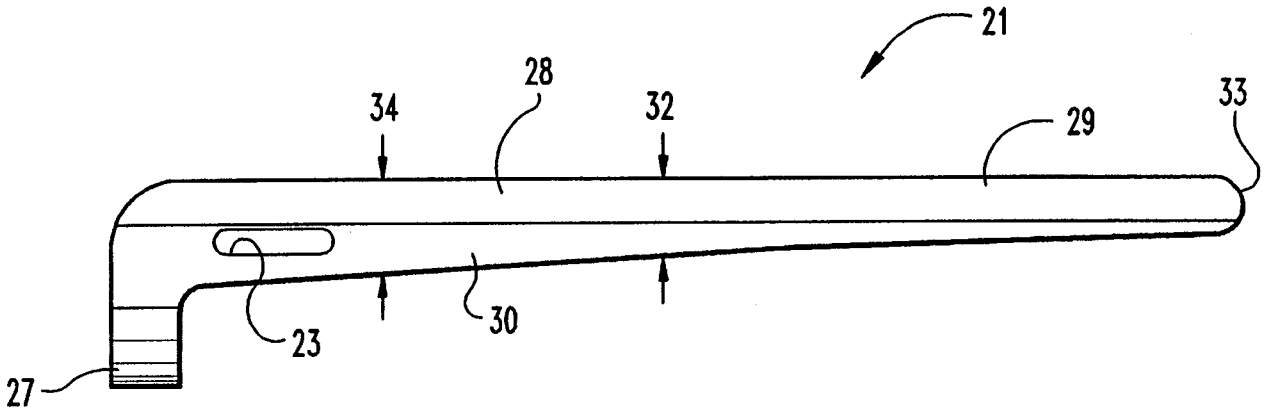
FIG. 4 is top elevation view of the cable guard of FIG. 2.
Figure 5:
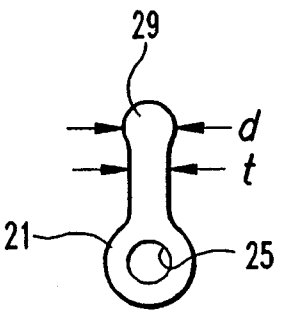
FIG. 5 is a side elevation view of the cable guard of FIG. 2.

As seen in FIGS. 4 and 5, cable guard 21 has a one-piece preferably aluminum construction and includes integrally joined mounting portion 27 and cable guard portion 28. The mounting portion 27 extends generally normally to the axis of cable guard portion 28 so as to offset cable guard portion 28 from the mounting hole 25 a distance which will provide a desired amount of maximum lateral deflection of the cables 17 and 18.

Cable guard portion 28 integrally includes a rod section 29 and a web section 30. The rod section 29 has a generally cylindrically shaped surface on the side facing the cables 17 and 18 and upon which is slidably received a cable guide 31 of conventional design. The web section 30 extends from the rod section 29 along the entire length of rod section 29. Web section 30 is tapered so that its width 32 continually decreases from a maximum width at the joint between mounting portion 27 and cable guard portion 28 to a minimum at the free end 33 of the cable guard. The tapering of web section 30 provides a total beam height 34 of cable guard portion 28 which is greatest at the joint between mountion portion 27 and cable guard portion 28 and continually decreases towards the free end 33. As best seen in FIG. 5, for material savings purposes web section 30 has a constant thickness "t" less than the diameter "d" of rod section 29. As seen in FIG. 4, web section 30 is hollowed at through slot 23 in order to provide a material savings. Cable guide 31 slidably receives cables 17 and 18 in guide grooves 35 located on the side opposite cable guard 21.

It may be appreciated that the one-piece construction of cable guard 21, along with the provision of stiffening web 30 provides a cable guard with increased structural rigidity for withstanding deflection forces associated with the cables 17 and 18. Unlike prior cable guard designs in which the rod section extends at a angle to the plane of the bow in order to compensate for the leaning in effect caused by cable deflection forces, the rod section 29 may be formed so that it extends parallel to the plane of the bow, i.e., parallel to the axis of mounting hole 25.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An improved cable guard for a compound archery bow having a riser, upper and lower bow limbs extending from said riser, pulleys mounted on said limbs, one or more cables trained around said pulleys and spanning said limbs, and a bowstring extending between said limbs, said cable guard comprising:

a one-piece cable guard member having integrally joined mounting and cable guard portions, said mounting portion adapted to mount to said riser with said cable guard portion extending rearwarly from said riser offset relative to a plane defined by said bow limbs and said bowstring, said cable guard portion having a free end, said cable guard portion having a beam height which decreases from said mounting portion towards said free end.

2. The cable guard of claim 1 wherein said cable guard portion integrally includes a rod section and a web section, said rod section having a generally cylindrically shaped cable guide slide surface having a constant diameter facing said cables, said web section extending from said rod section and having a width which continually decreases towards the free end of said cable guard.

3. The cable guard of claim 2 wherein said said web section having a thickness which is less than the diameter of said rod section.

4. The cable guard of claim 3 wherein said mounting portion having a mounting hole for attachment of said cable guard to said riser.

5. A compound archery bow comprising in combination, a riser, upper and lower limbs extending from said riser, pulleys mounted on said limbs, one or more cables trained around said pulleys and spanning said limbs, a bowstring extending between said limbs, and a cable guard mounted to said riser, said limbs and said bowstring defining a plane of said bow, said cable guard being of a one-piece construction and including integrally joined mounting and cable guard portions, said mounting portion being mounted to said riser with said cable guard portion extending rearwardly from said riser and offset from said plane of said bow, said cable guard portion having a free end, and said cable guard portion having a beam height which decreases from said mounting portion towards said free end.

6. The compound archery bow of claim 5 and further comprising a cable guide slidably mounted to said cable guard portion and defining guide grooves slidably receiving said cables.

7. The cable guard of claim 6 wherein said cable guard portion includes a rod section and a web section, said rod section having a generally cylindrically shaped cable guide slide surface having a constant diameter facing said cables, said web section extending from said rod section and having a width which continually decreases towards the free end of said cable guard, said cable guide slidably mounted on said generally cylindrically shaped surface of said rod section.

8. The cable guard of claim 7 wherein said mounting portion having a mounting hole for attachment of said cable guard to said riser.

* * * * *